US006265365B1

(12) United States Patent
Herget et al.

(10) Patent No.: US 6,265,365 B1
(45) Date of Patent: Jul. 24, 2001

(54) ROLLER WASH COMPOSITION

(75) Inventors: Gerhard Herget, Ober-Ramstadt; Brigitte Husseini, Darmstadt; Rüdiger Smolka, Biebesheim, all of (DE)

(73) Assignee: Merck Patent Gesellschaft Mit (DE)

( * ) Notice: Subject to any disclaimer, the term of this patent is extended or adjusted under 35 U.S.C. 154(b) by 0 days.

(21) Appl. No.: 09/417,763

(22) Filed: Oct. 14, 1999

(30) Foreign Application Priority Data

Oct. 14, 1998 (DE) ..... 198 47 171

(51) Int. Cl.[7] ..... C11D 9/00; C11D 9/02; C11D 9/04

(52) U.S. Cl. ..... 510/170

(58) Field of Search ..... 510/170, 171, 510/172, 173, 174

(56) References Cited

U.S. PATENT DOCUMENTS

| | | | | |
|---|---|---|---|---|
| 4,769,170 | * | 9/1988 | Omori et al. | 252/107 |
| 5,382,298 | * | 1/1995 | Bondurant | 134/42 |
| 5,667,594 | * | 9/1997 | Omure et al. | 134/26 |
| 5,691,288 | * | 11/1997 | Dhillon et al. | 510/171 |

* cited by examiner

*Primary Examiner*—Yogendra N. Gupta
*Assistant Examiner*—John M Petruncio
(74) *Attorney, Agent, or Firm*—Millen, White, Zelano & Branigan, P.C.

(57) ABSTRACT

The present description relates to a roller wash composition for the cleaning of the cylinder, polymer plate and other soiled parts of printing machines when using water-based printing inks.

8 Claims, No Drawings

ROLLER WASH COMPOSITION

BACKGROUND OF THE INVENTION

The present invention relates to a roller wash composition for cleaning the cylinder, polymer plate and other soiled parts of printing machines when using water-based printing inks. The wash composition can, furthermore, be used as a filling medium in ultrasound baths.

The cleaning of printing machines when using water-based printing inks requires specially formulated cleaning compositions. The wash compositions available on the market, based on aqueous alcoholic solutions of surface-active substances and glycol ethers, have the disadvantage that their cleaning power is too low, that they attack the metal of the machine components, and/or that their biodegradability is poor.

SUMMARY OF THE INVENTION

The object of the present invention is therefore to provide a cleaning composition which as well as cleaning the printing machine effectively has none of the above disadvantages.

A roller wash composition has surprisingly now been found for the cleaning of the cylinder, polymer plate and other soiled parts of printing machines which is characterized in that it comprises

| | |
|---|---|
| 5–80% by weight | of dihydric or polyhydric alcohols or glycol ethers, |
| 0.05–5% by weight | of surfactants |
| 0.5–10% by weight | of water-miscible organic solvents or solvent mixtures, and |
| 0.1–4% by weight | of pH regulators, |
| 0–0.005% by weight | of one or more biocides, and |
| 0–80% by weight | of water |

The wash composition of the invention is very suitable for cleaning polymer and rubber plates and for washing the inking units of printing machines. Furthermore, it is outstandingly suitable for removing dried-on ink from all parts of printing machines.

In the case of stubborn ink soiling it is recommended that the wash composition be used in concentrated form. The wash composition of the invention is, however, of infinite miscibility with water. Normally it is mixed with water in a ratio of from 1:1 to 2:1.

The wash composition is suitable both for manual use and for flushing the ink supply systems of gravure and flexographic printing machines.

A further advantage is that the wash composition is biodegradable.

An essential constituent of the wash composition is the surfactant employed, which is present in amounts of from 0.05 to 5% by weight, preferably from 0.5 to 2% by weight and, in particular, from 0.5 to 1% by weight, based on the wash composition.

The surfactants are preferably synthetic, organic, surface-active, detergent substances, which can be anionic, amphoteric, ampholytic, zwitterionic, nonionic or cationic in nature, or else a mixture of the said surfactants.

The anionic detersive base materials are by far the most important in this context. Many such detergents are described in "Surface Active Agents and Detergents", Vol. II by Schwartz, Perry and Berch (1958, Interscience Publishers, Inc.). The most common surfactants can also be read about in all of the major reference works of chemistry (e.g. Römpp, Beilstein, etc.). Any detergent suitable for the purpose can be used as the anionic surfactant. Normally, the surfactants based on anions comprise, for example, fatty alcohol sulfates, paraffin sulfonates, fatty acid condensation products and alkylbenzenesulfonates and alkylbenzenephosphonates, or alkyl sulfates and alkyl phosphates. The anionic surfactants are preferably sodium salts. Potassium, ammonium and triethanol-ammonium salts are often used in liquid compositions. The alkyl radicals are preferably straight-chain and possess preferably from 12 to 16 carbon atoms.

Synergistic combinations including, in particular, fatty alcohol polyglycol ethers have proved suitable as the basis of many compositions.

Suitable nonionic base materials are condensation products of lipophilic components and lower alkylene oxides or polyalkyleneoxy units. Preference is given to the use, for example, of the abovementioned fatty alcohol polyglycol ethers, the alkylphenol polyglycol ethers, or else fatty acid alkyl amides.

It is also possible to use cationic surfactants, examples being aliphatic quaternary ammonium salts. The substances known as builders are likewise known to the person skilled in the art, and can be organic or inorganic in nature, water-soluble or insoluble. It is preferred to use substances such as polyphosphates, e.g. pentasodium triphosphate, carbonates or bicarbonates, e.g. potassium or sodium carbonate, zeolites, e.g. zeolite A, polycarboxylates, e.g. sodium salts of the copolymers of acrylic acid and maleic acid, or else borates and silicates, e.g. sodium sheet silicate.

Preferred surfactants are selected from the group consisting of fatty alcohol polyglycol ethers, alkanesulfonates, alkyl ethoxylates and alkylbenzenesulfonates. These surfactants are obtainable commercially and are marketed for example under the brand names Marlipal®, Marlon® and Marlopon® by the company Hüls.

The solvent component must be tailored to the respective components in the roller wash composition. For the preparation it is possible not only to use water but all organic solvents which are readily miscible or emulsifiable with water. Suitable organic solvents are monohydric aliphatic alcohols, such as those having 2 to 4 carbon atoms, examples being ethanol, 1-propanol, 2-propanol and n-butanol, or ketones with varying alkane chains, or glycol ethers, such as propylene glycol monomethyl ether, propylene glycol monoethyl ether, propylene glycol or polyether diols, such as polyethylene glycol and polypropylene glycol or polyols, such as aliphatic triols having 2 to 6 carbon atoms, such as trimethylolethane, trimethylolpropane, glycerol, 1,2,4-butanetriol, 1,2,6-hexanetriol and penta-erythritol, and all other solvents from other classes of compound, or mixtures of the abovementioned solvents, which are listed in Karsten, Lackrohstoff-tabellen, 9th edition 1992.

The roller wash composition preferably contains from 0.5 to 10% by weight, in particular from 2 to 5% by weight, based on the wash composition, of monohydric alcohols having 2 to 4 carbon atoms, such as ethanol, 1-propanol and isopropanol, for example. An additional preferred consituent of the wash composition are the dihydric and polyhydric alcohols, which are present in a proportion of from 5 to 80% by weight, preferably from 5 to 45% by weight and, in particular, from 20 to 40% by weight.

As a further component, the wash composition preferably contains from 0 to 80% by weight of water, with particular preference from 40 to 80% by weight and, in particular, from 60 to 70% by weight.

Depending on the nature of the printing ink, neutral or alkaline roller wash compositions are required. It is therefore advisable to add neutralizing agents and/or pH regulators. Particularly suitable are bases, such as urea, urea derivatives, ammonia, amino alcohol, alkali metal hydroxides, such as KOH or NaOH, or amines, preferably low molecular mass organic amines, for example.

The base or pH regulator is added in an amount such that the pH of the roller wash composition is from about 7.5 to 13, preferably from 8 to 12. The wash composition generally contains from 0.1 to 4.0% by weight of a pH regulator, preferably from 1 to 3% by weight and, in particular, from 2 to 3% by weight.

Primary amino alcohols such as 2-amino-2-methyl-1-propanol, for example, can also be added to the roller wash composition. The amino alcohols have the function of regulating the pH and are used in amounts of from 0.01 to 10% by weight, preferably from 0.5 to 5% by weight and, in particular, from 0.5 to 2% by weight.

In many cases it is advisable to add an emulsifier. Particularly suitable are emulsifiers based on alkanesulfonates, or alkyl ethoxylates, as described, for example, by Karsten, Lackrohstofftabellen, 9th edition, 1992, pp. 586–588.

In addition to the abovementioned components, the roller wash composition may additionally include biocides in amounts of from 0 to 0.005% by weight, preferably from 0.001 to 0.005% by weight. All biocides known to the person skilled in the art are suitable—such as those known, for example, from Karsten, Lackrohstofftabellen, 9th Edition, 1992, Preservatives against Bacteria and Fungal Infestation, pp. 702–712, especially those based on chloroacetamide, isothiazolinane, benzimidazole derivatives, 5-chloro-2-methyl-, 2-methyl- or octylisothiazol-3-one. Suitable biocides are available commercially, for example, under the brand name Kathon® (from Rohm & Haas) or Mergal® (Riedel-de Häen).

Further auxiliaries which may be added to the roller wash composition of the invention include fragrances and adjuvants, colorants, bleaches or brighteners, antistats, antibacterials, fungicides, foam-forming reagents or foam inhibitors, antioxidants, or enzymes.

The cleaning composition of the invention can be present in solid form, as powder, as tablets, in block or cake form, as a paste, as a gel, in liquid form, as a wax, as a cream, as an emulsion, as a dispersion, as a foam, as a spray (aerosol form) or else any other suitable form adapted to the respective use.

The quantitative composition of the individual components for the various formulation options is well known to the person skilled in this art and need not be recited in any more detail here.

The roller wash compositions of the invention are preferably in the form of an aqueous or aqueous-alcoholic solution, a detergent, a wax, a gel, an emulsion, a shampoo, a spray, a dispersion or a solid product.

In the roller wash composition of the invention, the proportions of synthetic organic surfactants, solvents and auxiliaries are similar and can be varied over wide ranges. The roller wash composition of the invention consists preferably of 5.0–80% by weight of dihydric or polyhydric alcohols, preferably glycerol or glycol ethers, from 0.05 to 5.0% by weight of surfactants, from 0.5 to 10% by weight of monohydric alcohols and up to 10% by weight of additives. As the remainder (to 100% by weight) it is usual to add water, alcohols, auxiliaries and/or emulsifiers.

The methods of preparing such products are known to the skilled worker in the art of soaps and detergents production and need not be stated further here. Such methods include dry mixing, dissolving and/or dispersing, and/or emulsifying.

Preferably, for the preparation of an aqueous or aqueous-alcoholic solution of the roller wash composition, the surfactant is dissolved in a suitable solvent, such as water, a lower alcohol, such as ethanol, propanol or an alcoholic mixture, for example. The individual components can be added to the solvent simultaneously or in succession. Subsequently, the mixture is stirred at from 20 to 80° C., preferably from 20 to 65° C., for from 0.5 to 5 h, preferably from 0.4 to 4 h.

The roller wash composition of the invention therefore provides the printing industry with essentially nontoxic and therefore highly environmentally friendly, and at the same time also highly effective, wash compositions. The roller wash composition of the invention can also be used as a filling medium in ultrasound baths.

Even without further remarks it is assumed that a person skilled in the art will be able to utilize the above description in its widest sense.

The preferred embodiments are therefore to be interpreted merely as a descriptive disclosure which in no way has any limiting effect at all. The examples which follow are intended to illustrate the invention.

EXAMPLES

Roller wash composition for gravure printing and flexographic applications, water based

Example 1

Composition

| | |
|---|---|
| 0.22% | Emulgator K 30 [emulsifier] |
| 0.22% | Marlipal ® 013/90 (Hüls, FRG) |
| 0.22% | Marlipal ® MG (Hüls, FRG) |
| 1.55% | pentasodium tripolyphosphate |
| 0.67% | 32% of sodium hydroxide solution |
| 5.00% | of 2-propanol |
| 20.00% | of glycerol |
| 72.13% | of DI water |

DI water is charged to a stirred vessel and the Emulgator K30 is added with stirring. The amounts indicated above of Marlipal® 013/90 (C13 oxa alcohol polyglycol ether), Marlipal® MG (C12 fatty alcohol polyglycol ether), melted beforehand, are added. Finally, the 32% of sodium hydroxide solution, 2-propanol and glycerol are added. The batch is stirred for 3 h.

Physical properties:

| | |
|---|---|
| pH: | 11 |
| Density (20° C.): | 1.07 g/cm3 |
| Boiling point: | 46° C. |
| Surface tension: | 31 mN/m |
| Biodegradability: | 859 TOC g/l (95% after 4 days) |

Example 2

Composition:

| | |
|---|---|
| 0.20% | of Marlipal ® SU (Hüls, FRG) |
| 0.40% | Marlon ® A 375 (Hüls, FRG) |
| 1.38% | of sodium polyphosphate |
| 0.60% | of Marlopon ® AT 50 (Hüls, FRG) |
| 0.112% | of 32% of sodium hydroxide solution |
| 0.002% | of Kathon ® ICP (Rohm & Haas) |
| 61.80% | of DI water |
| 30.00% | of glycerol |
| 5.00% | of 2-propanol |
| 0.50% | of 2-amino-2-methyl-1-propanol (25%) (Anguschemie) |

DI water is heated to 60° C. and then glycerol, 2-propanol, 2-amino-2-methyl-1-propanol, Marlipal® SU (fatty alcohol polyglycol ether), Marlon® A 375 (sodium alkylbenzenesulfonate), Marlopon® AT 50 (alkylbenzenesulfonate), sodium polyphosphate and the 32% sodium hydroxide solution are introduced. The batch is stirred at 60° C. for about 1 h. It is cooled to room temperature, Kathon® ICP (mixture of 5-chloro-2-methyl-4-isothiazolin-3-one and 2-methyl-4-isothiazolin-3-one) is added and the mixture is stirred for 0.5 h.

Physical properties:

| | |
|---|---|
| pH: | 9 |
| Density (20° C.): | 1.06 g/cm3 |
| Boiling point: | 43° C. |
| Surface tension: | 33.1 mN/m |
| Biodegradability: | 50% after 21 days |

The entire disclosure of all applications, patents and publications, cited above, and of corresponding German application No. 198 47 171.8 filed Oct. 14, 1998, is hereby incorporated by reference.

The preceding examples can be repeated with similar success by substituting the generically or specifically described reactants and/or operating conditions of this invention for those used in the preceding examples.

From the foregoing description, one skilled in the art can easily ascertain the essential characteristics of this invention and, without departing from the spirit and scope thereof, can make various changes and modifications of the invention to adapt it to various usages and conditions.

What is claimed is:

1. A roller wash composition for cleaning the cylinder, polymer plate and other soiled parts of printing machines, which comprises 5–80% by weight of an organic solvent selected from the group consisting of polyhydric alcohols, glycol ethers and combinations thereof, 0.05–5% by weight of one or more surfactants selected from the group consisting of fatty alcohol polyglycol ethers, alkane sulfonates, alkyl ethoxylates and alkylbenzenesulfonates, 0.5–10% by weight of one or more water-miscible organic solvents, other than polyhydric alcohols and glycol ethers, 0.1–4% by weight or one or more pH regulators, one or more biocides selected from the group consisting of chloroacetamide, benzimidazole derivatives, 5-chloro-2-methyl-octylisothiazol-3-one, 2-methyl-octylisothiazol-3-one, octylisothiazol-3-one and combinations thereof, in an amount that falls within the range 0–0.005% by weight, and 0–80% by weight of water.

2. A roller wash composition according to claim 1, characterized in that the polyhydric alcohol is glycerol, propylene glycol monomethyl ether propylene glycol monoethyl ether or a combination thereof.

3. A roller wash composition according to claim 1, characterized in that it further comprises from 0.01 to 10% by weight of an amino alcohol.

4. A roller wash composition according to claim 1, characterized in that one or more water miscible organic solvents is a monohydric alcohol having 2 to 4 carbon atoms.

5. A roller wash composition according to claim 1, wherein the one or more surfactants are selected from the group consists of a fatty alcohol polyglycol ether, alkyl ethoxylate, alkylbenzenesulfonate, alkane-sulfonate and combinations thereof.

6. A roller wash composition according to claim 1, which additionally comprises one or more emulsifiers other than alkylbenzenesulfonates and alkyl ethoxylates.

7. A roller wash composition according to claim 1, which is miscible with water in a ratio of from 1:1 to infinity.

8. A method of using a roller wash composition according to claim 1 which comprises incorporating said roller wash composition in a filling medium in ultrasound baths.

* * * * *

UNITED STATES PATENT AND TRADEMARK OFFICE

CERTIFICATE OF CORRECTION

PATENT NO. : 6,265,365 B1
DATED : July 24, 2001
INVENTOR(S) : Gerhard Herget et al.

It is certified that error appears in the above-identified patent and that said Letters Patent is hereby corrected as shown below:

Column 6,
Lines 24-25, "polyhydric alcohol is glycerol, propylene glycol monomethyl ether" should read -- organic solvent is glycerol, propylene glycol monomethyl ether, --.

Signed and Sealed this

Twenty-first Day of June, 2005

JON W. DUDAS
*Director of the United States Patent and Trademark Office*